US006887189B2

(12) United States Patent
Schiff

(10) Patent No.: US 6,887,189 B2
(45) Date of Patent: May 3, 2005

(54) COLLAR FOR WEIGHTLIFTING BAR

(76) Inventor: Jon D. Schiff, 4733 Vince Ct., St. Joseph, MI (US) 49085

( * ) Notice: Subject to any disclaimer, the term of this patent is extended or adjusted under 35 U.S.C. 154(b) by 525 days.

(21) Appl. No.: 10/153,574

(22) Filed: May 22, 2002

(65) Prior Publication Data

US 2003/0045407 A1 Mar. 6, 2003

Related U.S. Application Data

(60) Provisional application No. 60/315,442, filed on Aug. 28, 2001.

(51) Int. Cl.[7] ..... A63B 21/072

(52) U.S. Cl. ..... 482/107

(58) Field of Search ..... 482/93, 94, 98, 482/104, 106–109; 403/350, 374.1, 374.2, 375, 409.1

(56) References Cited

U.S. PATENT DOCUMENTS

| | | | | | |
|---|---|---|---|---|---|
| 3,863,916 | A | * | 2/1975 | Cline | 482/107 |
| 4,529,197 | A | | 7/1985 | Gogarty | |
| 4,638,994 | A | | 1/1987 | Gogarty | |
| 4,646,398 | A | * | 3/1987 | Myhrman | 482/107 |
| 5,496,243 | A | | 3/1996 | Allen | |
| 5,591,109 | A | * | 1/1997 | Strnad | 482/107 |

FOREIGN PATENT DOCUMENTS

| | | | | | |
|---|---|---|---|---|---|
| DE | 29806760 | U1 | * | 10/1998 | A63B/21/072 |
| GB | 2186500 | A | * | 8/1987 | A63B/13/00 |
| GB | 2397254 | A | * | 7/2004 | A63B/21/072 |

* cited by examiner

*Primary Examiner*—Justine R. Yu
*Assistant Examiner*—Victor K. Hwang
(74) *Attorney, Agent, or Firm*—Price, Heneveld, Cooper, DeWitt & Litten LLP

(57) ABSTRACT

A quick-release collar is provided for securing weight plates to a weight bar in the sport of weight lifting. The collar includes a collar body defining an opening for receiving the weight bar, and defining a tangential ramp leading to the opening. A lock rod engages the ramp, and a tie rod extends through the collar to the lock rod. A handle threads onto the tie rod and, when rotated, tensions the tie rod, pulling the lock rod against the ramp into a securely wedged, interlocked engagement with the bar.

12 Claims, 1 Drawing Sheet

COLLAR FOR WEIGHTLIFTING BAR

CROSS-REFERENCE TO RELATED APPLICATIONS

This application claims benefit of provisional application Ser. No. 60/315,442, filed Aug. 28, 2001, entitled COLLAR FOR WEIGHTLIFTING BAR.

BACKGROUND

The present invention relates to collars for retaining weights on a weight bar in the sport of weight lifting.

It is important that weights be securely retained on weight bars in the sport of weight lifting. It is also important that a weight lifter be able to quickly and easily change the number and size of weights, so that a good work out can be accomplished in a desired amount of time. Quick release collars and retainers are often used for this purpose. However, since weights and weight lifting equipment are, by definition, heavy, collars and other retainers tend to get damaged and wear out over time.

More specifically, many different retention devices have been made for retaining weights on weight bars in the sport of weight lifting. For example, some quick-release collars use a locking member with fingers that extend parallel the weight bar, and have a nut that slips over an end of the weight bar onto the fingers. The nut tightens the fingers onto the weight bar as the nut is rotated. By this arrangement, the fingers generate substantial friction to hold the weights on the weight bar. However, the fingers bend and wear out, the nuts wear out and/or become damaged, and hence the nuts on these collars lose their ability to rotate easily, and/or the collars generally lose their ability to be easily placed on the weight bar and tightened into a secure locking position. Another quick-release device includes a coiled section of spring steel rod designed to slip onto and frictionally engage an end of a weight bar. This quick-release device can be squeezed to open the coiled section and release the quick-release device for movement onto an end of a weight bar. When released, the coiled section springs back to a retaining position where the coil portion grips the weight bar. However, the coils bend open over time and/or lose their strength over time for various reasons, such that the devices no longer securely grip a weight bar. This can be a safety problem, since a strength of retention is lost slowly over time and may not be noticed until a problem occurs.

Accordingly, a collar is desired that solves the aforementioned problems and that has the aforementioned advantages.

SUMMARY OF THE PRESENT INVENTION

In one aspect of the present invention, a collar used to secure weight plates to a weight bar in the sport of weight lifting includes a collar body, a lock member, and a biasing member. The collar body includes a first surface defining an opening adapted to slidably receive a weight bar, and includes a ramp positioned radially outward from the opening that defines an angle to an adjacent portion of the first surface. The lock member engages the ramp. The biasing member is connected to the lock member and is operable to move the lock member along the ramp from a release position where the opening of the collar body is unobstructed and is adapted to slidably receive the bar, to a wedged locked position where lock member begins to intrude into the opening. The collar body, when the biasing member is in the wedged locked position, is adapted to be locked onto the bar to securely hold weight plates on the bar.

In another aspect of the present invention, a collar used to secure weight plates to a weight bar in the sport of weight lifting includes a collar body, a lock member, and a biasing member. The collar body has a first surface defining an opening adapted to slidably receive a weight bar. The lock member is positioned adjacent the opening and is movable in a transverse and tangential direction between a release position where the opening of the collar body is unobstructed and adapted to slidably receive the bar, to a wedged locked position where lock member begins to intrude into the opening in a manner adapted to clamp the bar in the opening. The biasing member is elongated and is positioned transverse to the opening in the collar body. The biasing member is operably coupled to the lock member and includes a handle that can be manipulated to move the lock member between the release position and the wedged locked position.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
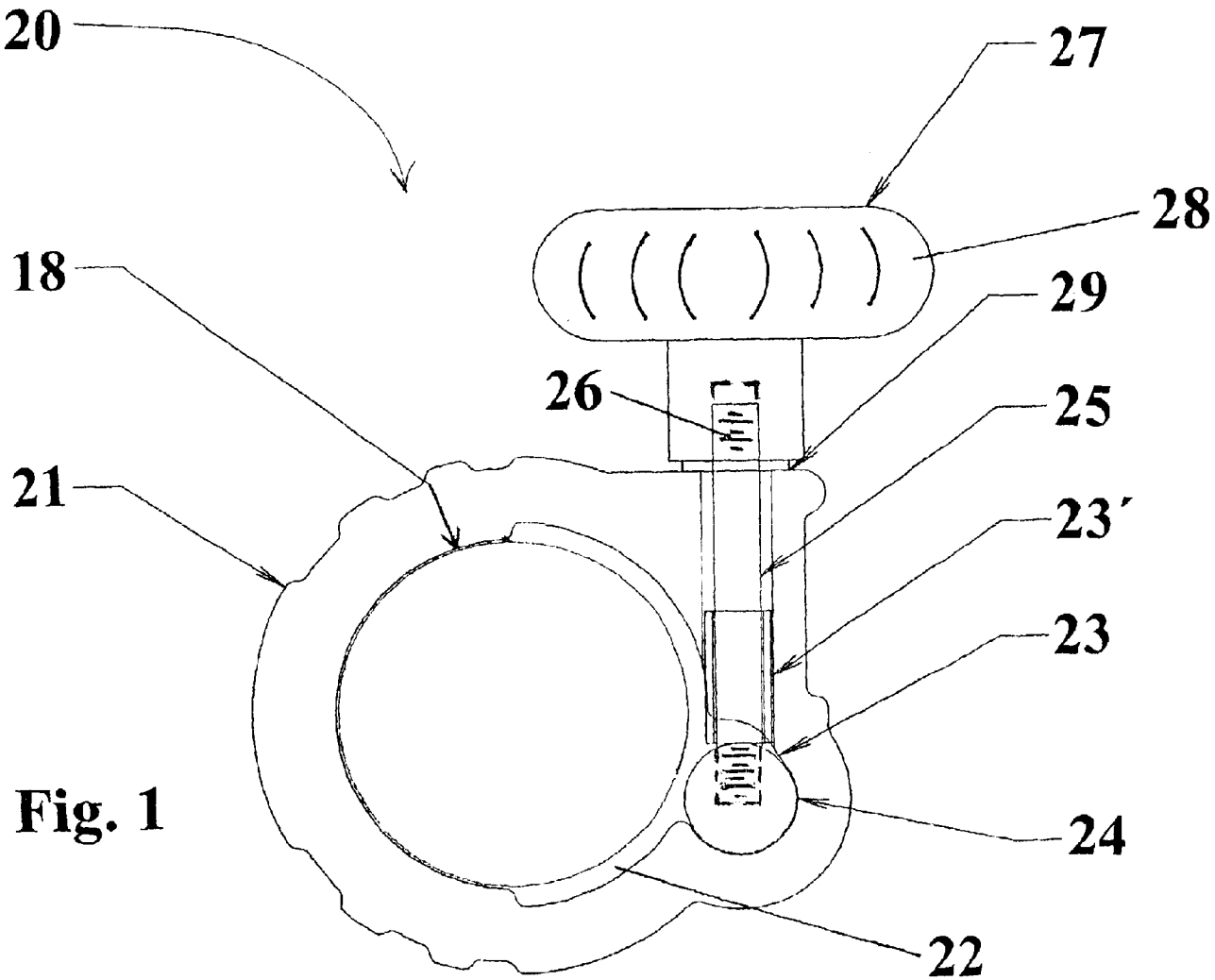
FIG. 1 is a side view of a collar embodying the present invention.

A quick-release collar 20 is provided for securing weight plates to a weight bar 18 in the sport of weightlifting. The collar 20 includes a collar body 21 defining an opening 22 for receiving the weight bar 18, and a spacer 23' defining a tangential curvilinear ramp 23 leading to the opening 22. A lock rod 24 engages the ramp 23, and a tie rod 25 extends through the collar body 21 to the lock rod 24. The tie rod 25 is secured to the lock rod 24 at one end, and includes a threaded end 26. A handle 27 threads onto the threaded end 26 of the tie rod 25. The handle 27 includes radial undulations 28 on its body so that it is easily grasp for rotation, and a washer 29 around the tie rod 25 under the handle 27 to optimize friction and wear characteristics for long term use. When rotated, the handle 27 threads onto the tie rod 25 and tensions the tie rod 25, pulling the lock rod 24 against the ramp 23 into a securely-wedged, interlocked engagement with the bar 18. By selecting optimal material hardnesses, threads per inch, and materials with particular desired frictional characteristics, the speed and ease of releasing and/or tightening the collar 20 on a weight bar 18 can be optimized for particular users and also the collar can be optimized for long-term wear and durability. For example, in the illustrated arrangement, the lock rod 24 is made from a high strength durable steel or similar material. Most wear occurs by virtue of inter-engagement and movement between the lock rod 24 and the weight bar 18. Since the weight bar 18 and lock rod 24 are high strength, minimal wear occurs. Further, if the lock rod 24 does somehow become damaged, the lock rod 24 can be replaced by unscrewing the tie rod 25 from the lock rod 24, and replacing the lock rod 24. In the illustrated arrangement, stress on the collar body 21 and the handle 27 are minimized or well-distributed, such that these parts do not tend to wear out very quickly.

It is contemplated that the present invention includes modifying the illustrated collar 20 to include a "compression tie rod" instead of a "tensioned" tie rod 25 as illustrated. For example, in the "compression tie rod" arrangement, the compression tie rod would threadably engage the collar body, and the ramp (23) would face in an opposite tangential direction. By rotating the handle (27), the compression tie rod would push the lock rod 24 along the ramp into a wedged locking position, with the same net result as the above-illustrated collar 20. This alternative is not as preferred due to pressure on the threads in the collar body, but it is an alternative.

It is to be understood that additional variations and modifications can be made on the aforementioned structure without departing from the concepts of the present invention, and further it is to be understood that such concepts are intended to be covered by the following claims unless these claims by their language expressly state otherwise.

I claim:

1. A collar used to secure weight plates to a weight bar in the sport of weight lifting, comprising:

a collar body with a first surface defining an opening adapted to slidably receive a weight bar, and including a ramp positioned radially outward from the opening that defines an angle to an adjacent portion of the first surface;

a lock member engaging the ramp; and a biasing member connected to the lock member and operable to move the lock member along the ramp from a release position where the opening of the collar body is unobstructed and is adapted to slidably receive the bar, to a wedged locked position where lock member begins to intrude into the opening, whereby the collar body, when the biasing member is in the wedged locked position, is adapted to be locked onto the bar to securely hold weight plates on the bar.

2. The collar defined in claim 1, including a handle attached to the biasing member for operating the biasing member to move the lock member between positions.

3. The collar defined in claim 1, wherein the opening includes a cylindrical arc portion and includes an enlarged recess area adjacent the lock member, the ramp.

4. The collar defined in claim 1, wherein the ramp is curvilinear and extends generally tangentially from an adjacent surface portion of the opening.

5. The collar defined in claim 1, wherein the biasing member includes a tie rod connected to the lock member.

6. The collar defined in claim 5, wherein the tie rod is threaded on at least one end, and including a threaded member threadably engaging the threaded one end of the tie rod for tensioning the tie rod.

7. The collar defined in claim 1, wherein the lock member includes a section of a rod.

8. The collar defined in claim 7, wherein the section of the lock member is elongated and extends parallel a centerline of the opening.

9. The collar defined in claim 1, wherein the biasing member draws the lock member in a tangential direction to the opening.

10. A collar used to secure weight plates to a weight bar in the sport of weight lifting, comprising:

a collar body with a first surface defining an opening adapted to slidably receive a weight bar;

a lock member positioned adjacent the opening and configured to slide in a transverse and tangential direction relative to the first surface between a release position where the opening of the collar body is unobstructed and adapted to slidably receive the bar, to a wedged locked position where the lock member begins to intrude into the opening in a manner adapted to clamp the bar in the opening; and an elongated biasing member positioned transverse to the opening in the collar body, the biasing member being operably coupled to the lock member and including a handle that can be manipulated to move the lock member between the release position and the wedged locked position.

11. The collar defined in claim 10, wherein the elongated biasing member includes a tie rod fixed to the lock member at one end and threaded on its other end, and includes a handle threadably engaging the threaded other end.

12. A method comprising steps of:

providing a collar including a collar body, a lock rod, and a tangentially-positioned biasing device connected to the lock rod and coupled to the collar body, the collar body defining an opening and the lock rod being movably positioned adjacent the opening; and manipulating the biasing device to slide the lock rod in a transverse and tangential direction relative to an inner surface of the opening from a release position where the lock rod is not in the opening, to a locking position partially in the opening where the lock rod is adapted to wedge against a weight bar in the opening of the collar body, the wedging action locking the collar onto the weight bar and in turn retaining any weight plates on the weight bar.

* * * * *